US011608592B2

(12) United States Patent
Long et al.

(10) Patent No.: US 11,608,592 B2
(45) Date of Patent: Mar. 21, 2023

(54) FIBER DYEING METHOD USING SUPERCRITICAL CARBON DIOXIDE FLUID AS MEDIUM

(71) Applicants: SOOCHOW UNIVERSITY, Suzhou (CN); SHANDONG GAOMIAN GROUP CO., LTD., Heze (CN)

(72) Inventors: Jiajie Long, Suzhou (CN); Chong Cai, Suzhou (CN); Chao Gao, Suzhou (CN); Wei Gao, Suzhou (CN)

(73) Assignees: SOOCHOW UNIVERSITY, Jiangsu (CN); SHANDONG GAOMIAN GROUP CO., LTD., Shandong (CN)

( * ) Notice: Subject to any disclaimer, the term of this patent is extended or adjusted under 35 U.S.C. 154(b) by 951 days.

(21) Appl. No.: 16/346,244

(22) PCT Filed: Nov. 6, 2018

(86) PCT No.: PCT/CN2018/114040
§ 371 (c)(1),
(2) Date: Apr. 30, 2019

(87) PCT Pub. No.: WO2020/077702
PCT Pub. Date: Apr. 23, 2020

(65) Prior Publication Data

US 2021/0355632 A1 Nov. 18, 2021

(30) Foreign Application Priority Data

Oct. 16, 2018 (CN) ..... 201811202696.0

(51) Int. Cl.

| | |
|---|---|
| ***D06P 1/94*** | (2006.01) |
| ***D06M 13/53*** | (2006.01) |
| ***D06P 1/00*** | (2006.01) |
| ***D06P 7/00*** | (2006.01) |
| *D06M 101/06* | (2006.01) |

(52) U.S. Cl.
CPC ..... *D06P 1/94* (2013.01); *D06M 13/53* (2013.01); *D06P 1/0016* (2013.01); *D06P 7/00* (2013.01); *D06M 2101/06* (2013.01); *D06P 2001/0084* (2013.01)

(58) Field of Classification Search
CPC .. D06P 1/0016; D06P 1/94; D06P 7/00; D06P 2001/0084; D06M 13/53; D06M 2101/06
See application file for complete search history.

(56) References Cited

U.S. PATENT DOCUMENTS

| | | | | |
|---|---|---|---|---|
| 2001/0020311 | A1* | 9/2001 | Veugelers | D06P 1/94 8/456 |
| 2015/0052692 | A1* | 2/2015 | Lee | D06M 23/105 8/475 |
| 2016/0194825 | A1* | 7/2016 | Long | D06B 5/12 68/184 |

FOREIGN PATENT DOCUMENTS

| | | | | |
|---|---|---|---|---|
| CN | 101091017 | A | 12/2007 | |
| CN | 102296469 | * | 12/2011 | D06P 1/16 |
| CN | 104562759 | A | 4/2015 | |
| CN | 104594072 | A | 5/2015 | |
| CN | 106468026 | A | 3/2017 | |
| CN | 108442058 | A | 8/2018 | |
| JP | 2004300588 | A | 10/2004 | |
| WO | 2015032020 | A1 | 3/2015 | |

* cited by examiner

*Primary Examiner* — Amina S Khan
(74) *Attorney, Agent, or Firm* — SZDC Law P.C.

(57) ABSTRACT

The invention discloses a waterless fiber dyeing method using supercritical carbon dioxide fluid as a medium. Dry fibers are tightly loaded layer by layer in a porous yarn cage. After dyeing, the fibers are cleaned to remove unfixed dyes by an online way, thereby obtaining waterless dyed dry fiber products with good quality. With the supercritical carbon dioxide dyed by a dye, the invention can not only solve the problems of high energy consumption, high discharge, high pollution in the traditional dyeing process, but also obtain better dyeing effect. The invention has a simple process and convenient operation, which can effectively realize dry dyeing processing. The reaction is mild, avoiding the use of a large amount of water, heat and additives in high concentration, which has the features of being high efficiency and environmentally friendly.

14 Claims, 1 Drawing Sheet

FIBER DYEING METHOD USING SUPERCRITICAL CARBON DIOXIDE FLUID AS MEDIUM

This application is the National Stage Application of PCT/CN2018/114040, filed on Nov. 6, 2018, which claims priority to Chinese Patent Application No.: 201811202696.0, filed on Oct. 16, 2018, which is incorporated by reference for all purposes as if fully set forth herein.

TECHNICAL FIELD

The invention relates to a waterless fiber dyeing method using supercritical carbon dioxide fluid as medium, which belongs to the technical field of textile dyeing and finishing.

BACKGROUND

Supercritical carbon dioxide fluid (SCF-$CO_2$) is used as a dyeing medium instead of water, and the process flow is short with convenient operation and no industrial waste water generated, so that the environmental problems caused by pollution of the textile processing are solved. Supercritical carbon dioxide has some properties similar to gas, such as low viscosity, high diffusion coefficient, small diffusion boundary, which facilitate to shorten the dyeing time. Moreover, after dyeing, the fluid can be discharged in gaseous form, so that the residual solid dyes and gas can be recycled, with no need of drying treatment, with a little or even no dyeing assistant, so that the materials are used to the best, which is environmentally friendly.

At present, waterless dyeing with supercritical carbon dioxide has been studied and discussed with respect to the fabric or cheese of polyester, nylon, acetate, acrylic, polypropylene, which has achieved satisfactory results. However, for hydrophilic natural staple fibers which take a bigger share such as cotton, wool, and other synthetic staple fibers, there has been relatively little research on waterless fiber dyeing in supercritical carbon dioxide fluid.

In particular, in a conventional water bath, expansion of natural staple fibers and diffusion of dyes are easily achieved, thereby obtaining a satisfactory dyeing effect. However, in the hydrophobic supercritical carbon dioxide fluid, some key issues such as how to break the hydrogen bond on the macromolecular chains of the staple fibers to create the necessary conditions for dyeing and how to improve the reaction and/or fixation of the dye reactive groups with the functional groups on the staple fibers need to be solved to implement waterless fiber dyeing in supercritical carbon dioxide fluid.

SUMMARY OF THE INVENTION

In order to solve the above technical problems, the present invention provides a waterless fiber dyeing method using supercritical carbon dioxide fluid as medium to overcome the deficiencies of the prior art.

A first object of the present invention is to provide a waterless fiber dyeing method using supercritical carbon dioxide fluid as medium, comprising steps of:

(1) loading cotton fibers in a dry manner layer by layer in a porous yarn cage at a certain compactness, wherein the cotton fibers are compacted mechanically;

(2) placing the yarn cage after loading cotton fibers in a dry manner in step (1) in a high pressure dyeing tank and preprocessing it;

(3) after preprocessing in step (2), introducing supercritical carbon dioxide medium and a dissolved dye into the high pressure dyeing tank, and supercharging, heating the yarn cage and dyeing by holding temperature according to a preset dyeing process;

(4) after dyeing by holding temperature, cooling dyeing system by clean supercritical carbon dioxide medium, and when the temperature in the dyeing system is lowered to a certain temperature, removing unfixed dyes by an online way, and finally recycling the fluid medium in the dyeing system to complete the waterless fiber dyeing in supercritical carbon dioxide fluid medium.

Preferably, the fibers are short natural fibers such as cotton, or processed hemp loose fibers, or synthetic fibers such as artificial short fibers made form viscose, polyester, nylon or acrylic.

Preferably, in step (1), loose cotton fibers are compacted layer by layer uniformly by a mechanical external force, so that the fibers can be loaded regularly at a certain compactness.

Preferably, the porous yarn cage in step (1) is coated with Teflon or other non-conductive surface materials, and a plurality of apertures are distributed on the periphery of the yarn cage and on its central hollow tube.

Preferably, in step (1), "layer by layer" means that the fibers are loaded or compacted regularly to form a layer, and then a next layer is formed in the same way, the process is repeated until a predetermined amount of fibers are loaded in the yarn cage.

Preferably, in step (1), the fibers have a compactness of 50-300 kg/$m^3$ when they are loaded layer by layer in the yarn cage.

Preferably, medium used in step (2) to preprocess the fibers is selected from the group consisting of saturated steam, superheated steam, and other polar solvents.

Preferably, in step (2), the fibers are preprocessed under a pressure of 0-1 MPa for 5-180 min.

Preferably, in step (3), the dissolved dye is an active disperse dye with an active group selected from the group consisting of a vinyl sulfone, a vinyl group, an s-triazine type, a nicotinic acid structure, and derivatives thereof.

Preferably, in step (3), the dissolved dye is dissolved in a solvent selected from the group consisting of supercritical carbon dioxide, ethanol, acetone, methanol, and deionized water.

Preferably, in step (3), two solvents are mixed at the ratio of 1:5 to 5:1.

Preferably, in step (3), in the preset dyeing process, the temperature is 50-160° C., the pressure is 7-35 MPa, a ratio of dynamic and static cycle time of the fluid is 1:5-10:1, and the processing time is 10~180 min.

Preferably, in step (4), the temperature in the dyeing system is lowered to 30-100° C.

Preferably, in step (4), during removing unfixed dyes by an online way, the conditions include that the temperature is 30-100° C., the pressure is 8-35 MPa, a ratio of dynamic and static cycle time of the fluid is 1:5-10:1, and the processing time is 10~120 min.

Preferably, in step (4), after dyeing, the carbon dioxide is separated and recycled by a recycling system for cyclic utilization, and the carbon dioxide in the dyeing system is recovered to atmospheric pressure for direct opening of the dyeing tank.

In the present invention, cotton fibers are loaded in a dry manner layer by layer and compacted to a certain compactness in a porous yarn cage, wherein the fibers are compacted mechanically, so that the fibers are tightly stacked and evenly distributed in the yarn cage, and the dyeing property is improved by preprocessing with some medium. Moreover, the process is simple, no traditional water bath is needed, no dyeing wastewater is generated, and the required process flow is short and the efficiency is high. After the dyeing is finished, the fibers can be cleaned by the fluid to remove unfixed dyes by an online way, thereby obtaining waterless dyed fiber products with good quality.

With the above solution, the present invention has at least the following advantages:

When the supercritical carbon dioxide is dyed with a dye, the invention can not only solve the problems of high energy consumption, high emission, high pollution in the traditional dyeing process with water bath, but also obtain better dyeing effect. The invention has a simple process and convenient operation, which can effectively realize dyeing processing. The reaction is mild, avoiding the use of a large amount of water, heat and additives in high concentration in the traditional dyeing process, which has the features of being high efficiency and environmentally friendly.

Figure 2:
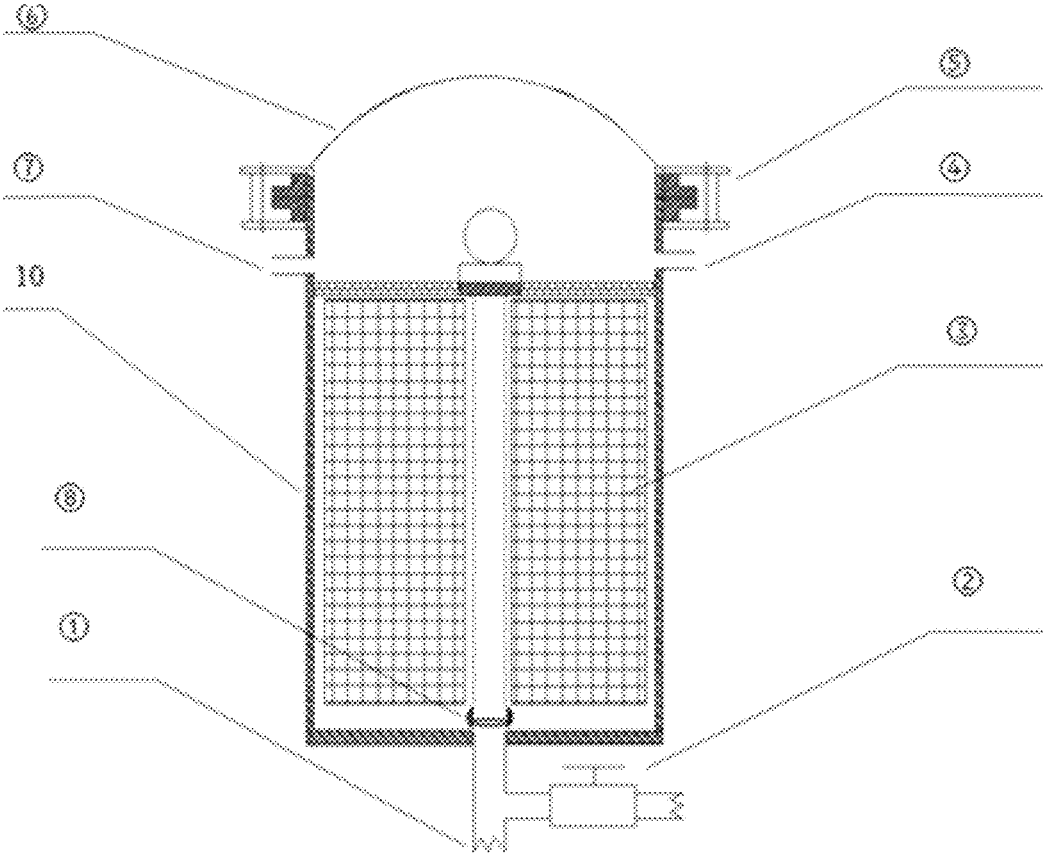

wherein: 1-$CO_2$ storage tank; 2-shut-off valve; 3-condenser; 4-booster pump; 5-preheater; 6-shut-off valve; 7-dye dissolving unit; 8-filter; 9-shut-off valve; 10-fiber dyeing tank; 11-shut-off valve; 11'-shut-off valve; 12-circulating pump; 12'-gas recycling pump; 13-shut-off valve; 14-shut-off valve; 15-micrometering valve; 16-thermometer; 17-pressure gauge; 18-separation kettle; 19-thermometer; 20-pressure gauge; 21-purifier;

FIG. 2 is a cross-sectional view of the fiber dyeing tank, wherein: ①-fluid and dye inlet; ②-inlet shut-off valve for non-carbon dioxide medium; ③-(porous) yarn cage; ④-fluid outlet; ⑤-quick opening structure; ⑥-dyeing tank seal cover; ⑦-inlet for non-carbon dioxide medium; ⑧-port.

DETAILED DESCRIPTION OF THE EMBODIMENTS

The invention will be further described in conjunction with specific examples, but these examples are just illustrative rather than restrictive. The features and effects of the present invention are apparent to those skilled in the art from this disclosure, and the invention may also be implemented or utilized through other different embodiments. Experiments in the embodiments that do not specify specific conditions in detail are generally performed in accordance with conventional conditions set forth in such as manufacturer's instructions, experimental guides, or textbook contents.

The staple fiber used in the embodiments of the present invention is cotton fiber, which is dry fiber not processed before dyeing; the dye used is active disperse yellow or active disperse red for supercritical carbon dioxide.

Figure 1:
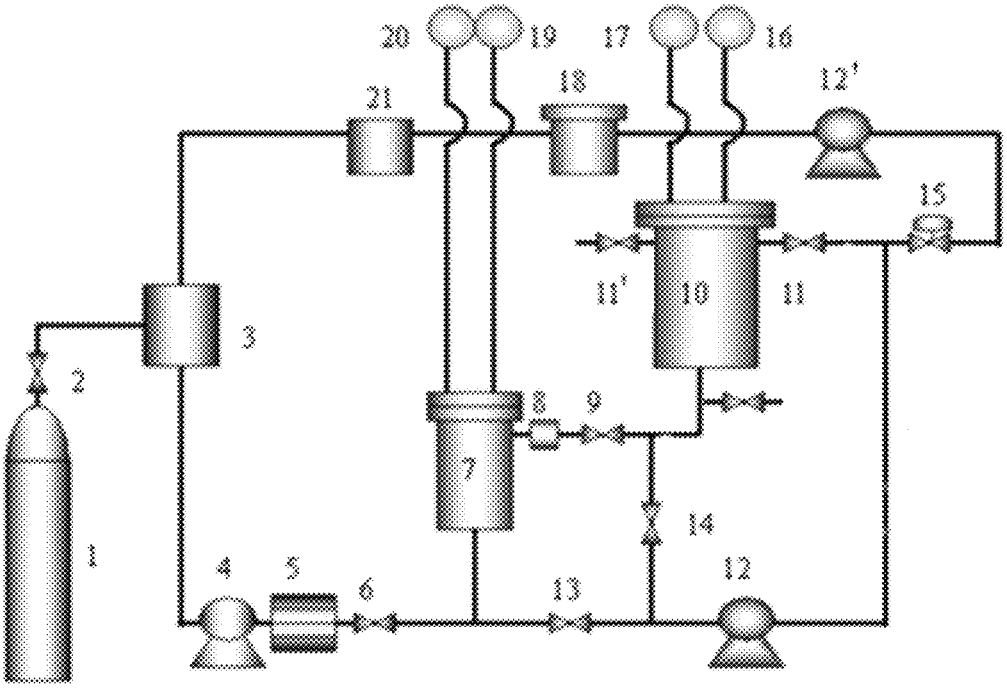
FIG. 1 is a schematic diagram of a system for dyeing fabrics in a supercritical carbon dioxide fluid according to an embodiment of the present invention.

Referring to FIG. 1 and FIG. 2, the steps of waterless fiber dyeing with supercritical carbon dioxide fluid in an embodiment of the present invention are as follows: dry fibers are loaded layer by layer in a porous yarn cage, wherein the dry fibers are compacted mechanically to a certain compactness (see the yarn cage in FIG. 2), and then the yarn cage is sealed and the seal cover ⑥ of the dyeing tank is closed; the shut-off valves 9, 14 are closed, the inlet shut-off valve ② for non-carbon dioxide medium is opened, and some non-carbon dioxide medium (such as saturated steam, etc.) is introduced into the dyeing tank; the opening degree of the shut-off valve 11' is adjusted to maintain the pressure in the dyeing tank as 0-1.0 Mpa; the fibers are preprocessed for 5~180 min. After the preprocessing is completed, the inlet shut-off valve ② for non-carbon dioxide medium and shut-off valves 11, 11' are closed, the shut-off valve 9 is opened, dissolved dye and $CO_2$ fluid is introduced into the dyeing tank 10 (FIG. 1). According to preset dyeing process and parameters, a pressurization system including a carbon dioxide storage tank 1, a condenser 3, a booster pump 4, and a preheater 5 is started to pressurize the dyeing circulation system and heat the fluid, so that the dye in the dye dissolving unit 7 is sufficiently dissolved. When the temperature of the dyeing circulation system reaches a preset value such as 120° C. and the pressure reaches a preset value such as 20 MPa, the booster pump 4 is stopped, the shut-off valve 6 is closed, the circulation pump 12 in the dyeing circulation circuit is enabled. The dissolved dye is circulated with the fluid and the fibers are sufficiently dyed. The ratio of dynamic cycle time to static cycle time of the fluid during dyeing is 5:1. Under static and cyclic conditions, the dissolved dyes are in sufficient contact with the fibers in the (porous) yarn cage 3 through their own molecular thermal motion and fluid mass transfer, and the dyes are adsorbed, diffused and fixed.

After dyeing by holding temperature and pressure, the micrometering valve 15 is opened to depressurize the system, and the dye and fluid in the dyeing circulation system are separated and recycled by a separating and recycling system including a gas recycling pump 12', a separation kettle 18, a purifier 21 and a condenser 3.

After the fluid is separated and recycled, the above operation is repeated to remove unfixed dyes by an online way, wherein the temperature is 30-100° C., the pressure is 8-35 MPa, the ratio of dynamic cycle time to static cycle time of the fluid is 1:5-10:1, and the cleaning time is 10~120 min. After the cleaning is completed, the gas and dye are separated and recycled by a pressure relief system, and the pressure in the dyeing tank is lowered to atmospheric pressure. Finally, the fiber dyeing tank 10 is opened, and the dyed fibers are taken out from the yarn cage. Referring to the above-mentioned processing steps, the fibers are dyed with the active disperse dye. The results of analysis and test are as follows:

1. Measurement of Color Characteristic Value and Evaluation of Levelness of Waterless Dyed Samples Surface color depth (K/S) and chromaticity values (L*, a*, b*, C*, and h°) of waterless dyed samples in supercritical carbon dioxide fluid are measured using a Hunterlab Ultrascan PRO spectrophotometer. During test, a D65 light source is selected with a viewing angle of 10°. The samples are made by mixing the fibers uniformly, and each sample is randomly tested for 8 points, and finally an arithmetic mean is calculated.

The levelness of the fiber is evaluated by a standard deviation of the surface color depth at the maximum absorption wavelength of the sample to be tested ($\sigma_{K/S(\lambda_{max})}$), which is calculated as below in (1).

$$\sigma_{K/S(\lambda_{max})} = \sqrt{\frac{\sum_{i=1}^{n} [(K/S)_{i,\lambda_{max}} - \overline{K/S}(\lambda_{max})]^2}{n-1}} \quad (1)$$

-continued $$\overline{K/S}(\lambda_{max}) = \frac{1}{n}\sum_{i=1}^{n}(K/S)_{i,\lambda_{max}} \quad (2)$$

wherein i represents the i-th test point (i=1, 2, 3, . . . , n; here n=8); $(K/S)_{i,\lambda_{max}}$ represents the surface color depth at the maximum absorption wavelength of the i-th test point; $\overline{K/S}(\lambda_{max})$ represents the arithmetic mean of the surface color depth of the n test points at the maximum absorption, as calculated in (2).

2. Color Fastness Performance Test

According to GB/T 3921-2008 about evaluation to the waterless dyed fiber samples in supercritical carbon dioxide for fastness to soaping, some samples are sutured with an adjacent fabric with multi-fibre components (SDC Multifiber DW, SDC enterprises CO., Ltd., UK) as a combined sample, the soap concentration is 5 g/L, the bath ratio is 1:50, and the washing fastness tester is operated at a temperature of 40° C. and the sample is washed for 30 min. After washing, the combined sample is taken out and rinsed with water, and allowed to dry naturally at room temperature. Then, under the $D_{65}$ light source, the discoloration degree of the sample and the staining degree of the adjacent fabric are respectively evaluated by grey scale for assessing change in color and grey scale for assessing staining.

Embodiment 1

Table 1 and table 2 show the experimental results of dyeing of 1 g of pure cotton fibers using active disperse yellow dye (o.m.f of 5%) by the method described in this embodiment. 2.5 g/L of saturated steam was introduced into the yarn cage before dyeing to perform preprocessing, and 10 ml of acetone was added in the dye dissolving unit to pre-dissolve the dye. The dyeing was performed as follows: in supercritical carbon dioxide fluid under 20 MPa, the fibers were dyed by the static fluid for 5 minutes followed by the cycled fluid for 1 minute, the dyeing temperature was 120° C., the bath ratio was 1:2000, and the total dyeing time was 60 min. After dyeing, the cleaning temperature was 80° C., the pressure was 20 MPa, and the total cleaning time was 30 min.

TABLE 1

Measurement of the color characteristic value and evaluation of levelness of the sample in Embodiment 1

| Sample serial number | L* | a* | b* | C* | h° | $\overline{K/S}$ ($\lambda_{max}$, nm; 410 nm) | $\sigma_{K/S(\lambda_{max})}$ |
|---|---|---|---|---|---|---|---|
| 1. | 75.70 | 0.59 | 19.96 | 19.97 | 88.30 | 1.124 | 0.045 |

TABLE 2

Evaluation of color fastness to washing of the sample in Embodiment 1

| Sample serial number | fastness to soaping | | | | | | |
|---|---|---|---|---|---|---|---|
| | | Staining | | | | | |
| | fade | Cotton | Wool | Acrylic | Polyester | Nylon | Acetate |
| 1. | 3-4 | 3-4 | 3-4 | 5 | 5 | 3-4 | 4 |

The experimental results in Table 1 show that, by means of the waterless fiber dyeing method of the present invention, a good dyeing effect can be achieved for the dry cotton fibers using the active disperse yellow dye. The hue angle h° of the waterless dyed sample in Embodiment 1 is 88.30, and the yellow color light is relatively pure and the color is bright. At the same time, under a condition of a large fluid ratio of 1:2000, the surface color depth value $\overline{K/S}(\lambda_{max})$ can reach 1.124, which shows that it has good dyeing and fixing properties under the technical conditions of the present invention. Meanwhile, Table 1 also shows that the standard deviation of the surface color depth value of the sample in embodiment 1 is relatively small, and the value of $\sigma_{K/S(\lambda_{max})}$ is 0.045, indicating that the sample in Embodiment 1 has excellent leveling property.

Table 2 shows that the regular color fastness of the sample in Embodiment 1 is good with the waterless fiber dyeing method of the present invention. Its fade grade is 3-4. The color fastness to acrylic, polyester and acetate can reach 4 level or above. For cotton, wool, nylon, the color fastness is also 3-4 level. The above results show that the present invention can obtain a good waterless dyeing effect on the sample in Embodiment 1.

Embodiment 2

Table 3 and Table 4 are experimental results of dyeing of 1 g of pure cotton fiber using active disperse yellow dye (o.m.f of 5%) by the method described in this embodiment. 2.5 g/L of saturated steam is introduced into the yarn cage before dyeing to perform preprocessing, and 10 ml of methanol is added in the dye dissolving unit to pre-dissolve the dye. The dyeing conditions are as follows: in supercritical carbon dioxide fluid under 20 MPa, the fibers are dyed by the static fluid for 5 minutes followed by the cycled fluid for 1 minute, the dyeing temperature is 120° C., the bath ratio is 1:2000, and the total dyeing time is 60 min. After the dyeing is completed, the cleaning temperature is 80° C., the pressure is 20 MPa, and the total cleaning time is 30 min.

TABLE 3

Measure of the color characteristic value and evaluation of levelness of the sample in Embodiment 2

| Sample serial number | L* | a* | b* | C* | H° | $\overline{K/S}$ ($\lambda_{max}$, nm; 410 nm) | $\sigma_{K/S(\lambda_{max})}$ |
|---|---|---|---|---|---|---|---|
| 2 | 74.88 | 2.04 | 23.14 | 23.23 | 84.97 | 1.280 | 0.022 |

TABLE 4

Evaluation of color fastness to washing of the sample in Embodiment 2

| Sample serial number | fastness to soaping | | | | | | |
|---|---|---|---|---|---|---|---|
| | | Staining | | | | | |
| | fade | Cotton | Wool | Acrylic | Polyester | Nylon | Acetate |
| 2 | 3-4 | 4 | 4 | 5 | 5 | 4 | 4-5 |

The experimental results in Table 3 show that, with the waterless fiber dyeing method of the present invention, a good dyeing effect on the dry cotton fiber can be achieved with the active disperse yellow dye. The hue angle h° of the sample in Embodiment 2 is 84.97, and the yellow color light is also relatively pure, the color is relatively bright, and the C* value is increased to 23.23. At the same time, the sample in Embodiment 2 is also under fluid conditions with the same proportion, the surface color depth value $\overline{K/S}(\lambda_{max})$ can also reach 1.280, which also demonstrates that the sample in Embodiment 2 has good dyeing and fixing properties. Meanwhile, Table 3 also shows that the standard deviation of the surface color depth value of the sample in Embodiment 2 is relatively small, the value of $\sigma_{K/S(\lambda_{max})}$ is 0.022, indicating that the sample in Embodiment 2 has excellent leveling property.

Table 4 shows that the conventional color fastness of the sample in Embodiment 2 is also good with the waterless fiber dyeing method of the present invention. Its fade grade is 3-4. The color fastness to cotton, wool, acrylic, polyester, nylon and acetate can reach 4 or above, and the colour fastness to washing is good. The above results show that the present invention can obtain a good waterless dyeing effect on the sample in Embodiment 2.

Embodiment 3

Table 5 and Table 6 are experimental results of dyeing of 1 g of pure cotton fiber using active disperse yellow dye (o.m.f of 2%) by the method described in this Embodiment. 5 g/L of saturated steam is introduced into the yarn cage before dyeing to perform preprocessing, and 15 ml of acetone is added to pre-dissolve the dye. The dyeing conditions are as follows: in supercritical carbon dioxide fluid under 20 MPa, the fibers are dyed by the static fluid for 5 minutes followed by the cycled fluid for 1 minute, the dyeing temperature is 130° C., the bath ratio is 1:2000, and the total dyeing time is 40 min. After the dyeing is completed, the cleaning temperature is 80° C., the pressure is 20 MPa, and the total cleaning time is 30 min.

TABLE 5

Measurement of the color characteristic value and evaluation of levelness of the sample in Embodiment 3

| Sample serial number | L* | a* | b* | C* | H° | $\overline{K/S}$ ($\lambda_{max}$, nm; 425) | $\sigma_{K/S(\lambda_{max})}$ |
|---|---|---|---|---|---|---|---|
| 3 | 72.66 | 1.06 | 25.16 | 24.42 | 88.97 | 1.264 | 0.056 |

TABLE 6

Evaluation of color fastness to washing of the sample in Embodiment 3

| Sample serial number | fastness to soaping | | | | | | |
|---|---|---|---|---|---|---|---|
| | fade | Staining | | | | | |
| | | Cotton | Wool | Acrylic | Polyester | Nylon | Acetate |
| 3 | 3-4 | 4 | 4 | 5 | 5 | 4 | 4 |

The experimental results in Table 5 show that, with the waterless fiber dyeing method of the present invention, a good dyeing effect on the dry cotton fiber can be achieved with the active disperse yellow dye under the experimental conditions. The hue angle h° of the sample is 88.97, the yellow color light is also relatively pure, the color is relatively brighte, and the C* value is increased to 24.42. At the same time, the sample in Embodiment 3 is also under fluid conditions with the same proportion, the surface color depth value $\overline{K/S}(\lambda_{max})$ can also reach 1.264, which also demonstrates that the sample in Embodiment 3 after preprocessing has good dyeing and fixing properties. Meanwhile, Table 5 also shows that the standard deviation of the surface color depth value of the sample in Embodiment 3 is relatively small, the value of $\sigma_{K/S(\lambda_{max})}$ is 0.056, indicating that the sample in Embodiment 3 has excellent leveling property.

Table 6 shows that the conventional color fastness of the sample in Embodiment 3 is also good with the waterless fiber dyeing method of the present invention. Its fade grade is 3-4. The color fastness to cotton, wool, acrylic, polyester, nylon and acetate can reach 4 or above, and the colour fastness to washing is good. The above results show that the present invention can obtain a good waterless dyeing effect on the sample in Embodiment 3.

Embodiment 4

Table 7 and Table 8 are experimental results of dyeing of 1 g of pure cotton fiber using active disperse red dye (o.m.f of 2%) by the method described in this embodiment. 5 g/L of saturated steam is introduced into the yarn cage before dyeing to perform preprocessing, and 15 ml of acetone is added to pre-dissolve the dye. The dyeing conditions are as follows: in supercritical carbon dioxide fluid under 20 MPa, the fibers are dyed by the static fluid for 5 minutes followed by the cycled fluid for 1 minute, the dyeing temperature is 130° C., the bath ratio is 1:2000, and the total dyeing time is 90 min. After the dyeing is completed, the cleaning temperature is 80° C., the pressure is 20 MPa, and the total cleaning time is 30 min.

TABLE 7

Measurement of the color characteristic value and evaluation of levelness of the sample in Embodiment 4

| Sample serial number | L* | a* | b* | C* | H° | $\overline{K/S}$ ($\lambda_{max}$, nm; 425) | $\sigma_{K/S(\lambda_{max})}$ |
|---|---|---|---|---|---|---|---|
| 4 | 74.46 | 18.65 | 1.34 | 23.53 | 1.59 | 1.276 | 0.029 |

TABLE 8

Evaluation of color fastness to washing of the sample in Embodiment 4

| Sample serial number | fastness to soaping | | | | | | |
|---|---|---|---|---|---|---|---|
| | fade | Staining | | | | | |
| | | Cotton | Wool | Acrylic | Polyester | Nylon | Acetate |
| 4 | 4 | 4 | 4 | 5 | 5 | 4 | 4-5 |

The experimental results in Table 7 show that, with the waterless fiber dyeing method of the present invention, a good dyeing effect on the dry cotton fiber can be achieved with the active disperse red dye. The hue angle h° of the sample is 1.59, the red color light is also relatively pure, the color is relatively bright, and the C* value is increased to 23.53. At the same time, the sample in Embodiment 4 is also under fluid conditions with the same proportion, the surface color depth value $\overline{K/S}(\lambda_{max})$ can also reach 1.276, which also demonstrates that the sample in Embodiment 4 after preprocessing has good dyeing and fixing properties. Meanwhile, Table 7 also shows that the standard deviation of the surface color depth value of the sample in Embodiment 4 is relatively small, the value of $\sigma_{K/S(\lambda_{max})}$ is 0.029, indicating that the sample in Embodiment 4 has excellent leveling property.

Table 8 shows that the conventional color fastness of the sample in embodiment 4 is also good with the waterless fiber dyeing method of the present invention. Its fade grade is 4. The color fastness to cotton, wool, acrylic, polyester, nylon and acetate can reach 4 or above, and the colour fastness to washing is good. The above results show that the present invention can obtain a good waterless dyeing effect on the sample in Embodiment 4.

Embodiment 5

Table 9 and Table 10 are experimental results of dyeing of 1 g of pure cotton fiber using active disperse red dye (o.m.f of 2%) by the method described in this embodiment. 2.5 g/L of saturated steam is introduced into the yarn cage before dyeing to perform preprocessing, and 15 ml of acetone is added to pre-dissolve the dye. The dyeing conditions are as follows: in supercritical carbon dioxide fluid under 20 MPa, the fibers are dyed by the static fluid for 5 minutes followed by the cycled fluid for 1 minute, the dyeing temperature is 120° C., the bath ratio is 1:2000, and the total dyeing time is 60 min. After the dyeing is completed, the cleaning temperature is 80° C., the pressure is 20 MPa, and the total cleaning time is 30 min.

TABLE 9

Measurement of the color characteristic value and evaluation of levelness of the sample in Embodiment 5

| Sample serial number | L* | a* | b* | C* | H° | $\overline{K/S}$ ($\lambda_{max}$, nm; 425) | $\sigma_{K/S(\lambda_{max})}$ |
|---|---|---|---|---|---|---|---|
| 5 | 76.88 | 12.52 | 27.95 | 30.63 | 85.87 | 1.494 | 0.012 |

TABLE 10

Evaluation of color fastness to washing of the sample in Embodiment 5

| Sample serial number | fade | fastness to soaping | | | | | |
|---|---|---|---|---|---|---|---|
| | | Staining | | | | | |
| | | Cotton | Wool | Acrylic | Polyester | Nylon | Acetate |
| 4 | 4 | 4 | 4-5 | 4-5 | 5 | 4 | 4-5 |

The experimental results in Table 9 show that, with the waterless fiber dyeing method of the present invention, a good dyeing effect on the dry cotton fiber can be achieved with the active disperse yellow dye. The hue angle h° of the sample is 85.87, $\lambda_{max}$=405 nm, the hue is yellow. Its C* value increases to 30.63, and the color is relatively bright. In addition, the sample in Embodiment 5 is also under fluid conditions with the same proportion, the surface color depth value $\overline{K/S}(\lambda_{max})$ can also reach 1.494, which also demonstrates that the sample in Embodiment 5 has good dyeing and fixing properties. Meanwhile, Table 9 also shows that the standard deviation of the surface color depth value of the sample in Embodiment 5 is relatively small, the value of $\sigma_{K/S(\lambda_{max})}$ is 0.012, indicating that the waterless dyed sample in Embodiment 5 has excellent leveling property.

Table 10 shows that the conventional color fastness of the sample in Embodiment 5 is also good with the waterless fiber dyeing method of the present invention. Its fade grade is 4. The color fastness to cotton, wool, acrylic, polyester, nylon and acetate can reach 4 or above, and the color fastness to washing is good. The above results show that the present invention can also obtain a good waterless fiber dyeing effect under the experimental conditions in Embodiment 5.

The embodiments described above are merely preferred embodiments for the purpose of fully illustrating the invention, and the scope of the invention is not limited thereto. Equivalent substitutions or modifications made by those skilled in the art based on the present invention are within the scope of the present invention. The scope of the invention is defined by the claims.

The invention claimed is:

1. A fiber dyeing method using supercritical carbon dioxide fluid as medium, comprising steps of:

(1) loading fibers in a dry manner layer by layer in a porous yarn cage at a compactness, wherein the fibers are compacted mechanically;

(2) placing the yarn cage after loading the fibers in a dry manner in step (1) in a high pressure dyeing tank and preprocessing the fibers with saturated steam or superheated steam under a pressure of 0-1 MPa for 5-180 min;

(3) after preprocessing in step (2), introducing supercritical carbon dioxide medium and a dissolved dye into the high pressure dyeing tank, and supercharging, heating the yarn cage and dyeing by holding temperature according to a preset dyeing process;

(4) after dyeing by holding temperature, cooling dyeing system by clean supercritical carbon dioxide medium, and when the temperature in the dyeing system is lowered to a temperature, removing unfixed dyes by an online way, and finally recycling the fluid medium in the dyeing system to complete the fiber dyeing in supercritical carbon dioxide fluid medium.

2. The fiber dyeing method using supercritical carbon dioxide fluid as medium according to claim 1, wherein the fibers are natural fibers or synthetic fibers.

3. The fiber dyeing method using supercritical carbon dioxide fluid as medium according to claim 1, wherein, in step (1), the fibers are compacted layer by layer uniformly by a mechanical external force, so that the fibers are loaded at the compactness.

4. The fiber dyeing method using supercritical carbon dioxide fluid as medium according to claim 1, wherein the porous yarn cage in step (1) is coated with a non-conductive surface material, and a plurality of apertures are distributed on the periphery of the yarn cage and on its central hollow tube.

5. The fiber dyeing method using supercritical carbon dioxide fluid as medium according to claim 1, wherein, in step (1), "layer by layer" means that the fibers are loaded or compacted to form a layer, and then a next layer is formed in the same way, the process is repeated until a predetermined amount of fibers are loaded in the yarn cage.

6. The fiber dyeing method using supercritical carbon dioxide fluid as medium according to claim 1, wherein, in step (1), the fibers have a compactness of 50-300 kg/m$^3$ when they are loaded layer by layer in the yarn cage.

7. The fiber dyeing method using supercritical carbon dioxide fluid as medium according to claim 1, wherein, in step (3), the dissolved dye is an active disperse dye with an active group selected from the group consisting of a vinyl sulfone, a vinyl group, an s-triazine type, a nicotinic acid structure, and derivatives thereof.

8. The fiber dyeing method using supercritical carbon dioxide fluid as medium according to claim 1, wherein, in step (3), the dissolved dye is dissolved in a solvent selected from the group consisting of supercritical carbon dioxide, ethanol, acetone, methanol, and deionized water.

9. The fiber dyeing method using supercritical carbon dioxide fluid as medium according to claim 8, wherein, in step (3), two solvents are mixed at the ratio of 1:5 to 5:1.

10. The fiber dyeing method using supercritical carbon dioxide fluid as medium according to claim 1, wherein, in step (3), in the preset dyeing process, the temperature is 50-160° C., the pressure is 7-35 MPa, a ratio of dynamic and static cycle time of the fluid is 1:5-10:1, and the processing time is 10~180 min.

11. The fiber dyeing method using supercritical carbon dioxide fluid as medium according to claim 1, wherein, in step (4), the temperature in the dyeing system is lowered to 30-100° C.

12. The fiber dyeing method using supercritical carbon dioxide fluid as medium according to claim 1, wherein, in step (4), during removing unfixed dyes by an online way, the conditions include that the temperature is 30-100° C., the pressure is 8-35 MPa, a ratio of dynamic and static cycle time of the fluid is 1:5-10:1, and the processing time is 10~120 min.

13. The fiber dyeing method using supercritical carbon dioxide fluid as medium according to claim 1, wherein, in step (4), after dyeing, the carbon dioxide is separated and recycled by a recycling system for cyclic utilization, and the carbon dioxide in the dyeing system is recovered to atmospheric pressure for direct opening of the dyeing tank.

14. The fiber dyeing method using supercritical carbon dioxide fluid as medium according to claim 2, wherein the natural fibers are cotton or processed hemp loose fibers; and the synthetic fibers are artificial fibers made from viscose, polyester, nylon or acrylic.

* * * * *